US010170293B1

(12) United States Patent
Shan

(10) Patent No.: US 10,170,293 B1
(45) Date of Patent: Jan. 1, 2019

(54) ENHANCED LIGHTING CERAMIC METAL-HALIDE LAMP ASSEMBLY

(71) Applicant: Jason Shan, City of Industry, CA (US)

(72) Inventor: Jason Shan, City of Industry, CA (US)

( * ) Notice: Subject to any disclaimer, the term of this patent is extended or adjusted under 35 U.S.C. 154(b) by 0 days.

(21) Appl. No.: 15/901,728

(22) Filed: Feb. 21, 2018

(51) Int. Cl.

| | |
|---|---|
| ***H01J 31/14*** | (2006.01) |
| ***H01J 61/82*** | (2006.01) |
| ***H01J 61/30*** | (2006.01) |
| ***H01J 9/32*** | (2006.01) |
| ***H01J 9/24*** | (2006.01) |
| ***H01J 61/54*** | (2006.01) |

(52) U.S. Cl.
CPC ..... *H01J 61/827* (2013.01); *H01J 9/247* (2013.01); *H01J 9/323* (2013.01); *H01J 61/30* (2013.01); *H01J 61/545* (2013.01)

(58) Field of Classification Search
CPC ..... H01J 61/827; H01J 61/545; H01J 61/30; H01J 9/247; H01J 9/323; H01J 6/34; H01J 6/366; H01J 9/39; A01G 9/20; A01G 7/045
See application file for complete search history.

(56) References Cited

U.S. PATENT DOCUMENTS

| | | | | |
|---|---|---|---|---|
| 5,661,367 | A * | 8/1997 | Fellows | H01J 61/34 313/25 |
| 9,824,878 | B1 * | 11/2017 | Su | H01J 5/50 |
| 2014/0354175 | A1 * | 12/2014 | Iida | H01J 61/827 315/291 |
| 2018/0158666 | A1 * | 6/2018 | Su | H01J 61/92 |
| 2018/0158667 | A1 * | 6/2018 | Su | A01G 9/20 |
| 2018/0158668 | A1 * | 6/2018 | Su | A01G 9/20 |

* cited by examiner

*Primary Examiner* — Joseph L Williams
*Assistant Examiner* — Jose M Diaz
(74) *Attorney, Agent, or Firm* — Elizabeth Yang

(57) ABSTRACT

An enhanced lighting ceramic metal-halide lamp assembly provides a ceramic metal-halide lamp that operates to illuminate at high temperatures, have an increased life span, and improved color temperatures, color renderings, and luminous efficacies. The lamp assembly includes an at least partially transparent container forming a vacuum. Inside the container, a plurality of ceramic arc tubes are connected by two U-shaped coupling mechanisms. The coupling mechanisms are conductive and resilient, so as to provide both conductivity, and a buffering clearance between the ceramic arc tubes. The lamp assembly is also unique in that it provides a 630 watt double ended ceramic metal-halide lamp, as the ceramic arc tube produces 630 watts, uses about 200 volts and 3 Amps when illuminating. At least one fastening bracket, having resiliency, extends between the ceramic arc tube and inner surface of the container to help stabilize the ceramic arc tubes inside the elongated container.

20 Claims, 5 Drawing Sheets

300

| PERFORMANCE DATA | | |
|---|---|---|
| Initial lumens at rated watts after 100 hours operation | 78500 | Lm |
| Rated average life | 10000 | H |
| Warm up time | 7 | Min |
| Correlated color temperature | 3100 | K |
| Color rendering index | ⩾90 | |
| Operating Position | HOR±15° | |
| PAR value（380-780nm） | 12000 | μ mol/s |
| Lumens per Watt (lm/w) | 125 | lm/w |

FIG. 3A

302

| ELECTRICAL CHARACTERISTICS | | |
|---|---|---|
| Nominal lamp wattage | 630 | W |
| Nominal lamp voltage | 200 | V |
| Nominal lamp current | 3 | A |

FIG. 3B

304

| PHYSICAL DESCRIPTION | | |
|---|---|---|
| Maximum overall length | 388* | mm |
| Max Bulb diameter | 32.5 | mm |
| Pulse position (Electrical Degrees) | 60-90, 240-270 | degrees |
| Maximum bulb temperature | 700 | ℃ |
| Bulb designation | T32.5 | |
| Bulb material | Quartz glass | |
| Arc tube material | PCA | |
| Bulb finish | Clear | |

FIG. 3C

ENHANCED LIGHTING CERAMIC METAL-HALIDE LAMP ASSEMBLY

FIELD OF THE INVENTION

The present invention relates generally to an enhanced lighting ceramic metal-halide lamp assembly. More so, the present invention relates to a ceramic metal-halide lamp that provides enhanced lighting at higher temperatures and improved color temperatures, color renderings, and luminous efficacies through use of a 630 watt double ended ceramic metal-halide lamp. The lamp assembly also utilizes two conductive and resilient U-shaped coupling mechanisms that connecting each of the ceramic arc tubes to one of the sealed conductive ends of the container to provide conductivity and a buffering clearance between the ceramic arc tubes

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a ceramic metal-halide lamp is a source of light that is a type of metal-halide lamp which is about 10-20% more efficient than the traditional quartz metal halide. A ceramic metal-halide lamp uses ceramic instead of the quartz of a traditional metal halide lamp. It is known that ceramic arc tubes allow higher arc tube temperatures, which some manufacturers claim results in better efficacy, color rendering, and color stability.

Generally, lighting from ceramic metal-halide lamps produces bright, white light. The ceramic arc tubes generate electrical arcs between tungsten electrodes housed in a translucent or transparent fused quartz or ceramic arc tube, which is enclosed within an outer bulb. The tube contains a mixture of various gases and metal halide salts. For instance, ceramic arc tubes heat a mixture of mercury, argon and halide salts. As the arc heats up it vaporizes the metal salts to form a plasma, which intensifies the light produced by the arc and cuts down the power consumption.

It is known that, compared with incandescent and fluorescent lighting, ceramic metal-halide lamps have a higher luminous efficacy since a bigger proportion of their radiation is in visible light, not heat. Generally, ceramic metal-halide lamps are more resistant than standard quartz metal halide tubes to the corrosion metal halide salts create within the arc tube. This allows the ceramic arc tubes to operate at higher temperatures than quartz metal halide tubes, boosting performance and quality-of-light characteristics as lumen maintenance (10-30 percent higher), lamp color-shift and spread stability, Color Rendering Index (CRI) and dimming.

However, ceramic metal-halide lamps do have limitations. Throughout their lifetime, all metal halide lamps experience reduced light output and some increase in power consumption. Further, ceramic metal-halide lamps are susceptible to having their ceramic arc tubes damaged from impact and buffering forces. The color temperatures, color renderings, and luminous efficacies are also not optimal in these previous lamps.

Other proposals have involved ceramic metal halide lamps with enhanced illumination properties and extended life spans. The problem with these ceramic metal halide lamps is that they do not provide the optimal 630 watts of power. Also, they do not stabilize the ceramic arc tubes sufficiently inside the tube. Even though the above cited ceramic metal halide lamps meet some of the needs of the market, an enhanced lighting ceramic metal-halide lamp assembly that provides enhanced lighting at higher temperatures and improved color temperatures, color renderings, and luminous efficacies through use of a 630 watt double ended ceramic metal-halide lamp; and further provides two conductive and resilient U-shaped coupling mechanisms that connecting each of the ceramic arc tubes to one of the sealed conductive ends of the container, so as to provide conductivity and a buffering clearance between the ceramic arc tubes, is still desired.

SUMMARY

Illustrative embodiments of the disclosure are generally directed to an enhanced lighting ceramic metal-halide lamp assembly. The lamp assembly serves to provide enhanced lighting at higher temperatures and improved color temperatures, color renderings, and luminous efficacies through use of a 630 watt double ended ceramic metal-halide lamp. The lamp assembly also utilizes two conductive and resilient U-shaped coupling mechanisms that connecting each of the ceramic arc tubes to one of the sealed conductive ends of the container to provide conductivity and a buffering clearance between the ceramic arc tubes. At least one fastening bracket, having resiliency, helps stabilize the ceramic arc tubes inside the elongated container.

In some embodiments, the lamp assembly comprises an at least partially transparent container defined by an inner surface, an outer surface, a pair of sealed conductive ends, and an inner volume defined by a vacuum. The lamp assembly may further include a plurality of ceramic arc tubes that are disposed in the inner volume of the at least partially transparent container. This being a halide-metal style lamp, the ceramic arc tubes being filled with an ionizable gaseous mixture.

In one embodiment, the lamp assembly provides a ballast that is disposed in the inner volume of the ceramic arc tubes, the ballast comprising at least one electrode generating an electric arc through the ionizable gaseous mixture. The electric arc is operational to vaporize the gaseous mixture, which creates a plasma to generate illumination. In one non-limiting embodiment, the ceramic arc tube produces about 630 watts of power when illuminating.

In some embodiments, a wire may extend between the pair of sealed conductive ends of the at least partially transparent container. The wire carries an electrical current through the ballast, so as to enable energizing the electrodes.

In some embodiments, the lamp assembly may further include two U-shaped coupling mechanisms. The two U-shaped coupling mechanisms are integral to the wire. The two U-shaped coupling mechanisms connect each of the ceramic arc tubes to one of the sealed conductive ends of the container. The two U-shaped coupling mechanisms are defined by a conductive material, and are generally resilient. In this manner, the two U-shaped coupling mechanisms provide conductivity and a buffering clearance between the ceramic arc tubes and the sealed conductive ends of the container.

In one embodiment, the lamp assembly provides at least one fastening bracket that helps secure the ceramic arc tubes in a stabilized position inside the at least partially transparent container. The fastening bracket is defined by a first end and a second end. The first end engages the inner surface of the at least partially transparent container for stabilizing the ceramic arc tubes. The second end engages the ceramic arc tubes. The fastening bracket is also resilient, so as to enable buffering and to protect against impactful forces against the container or ceramic arc tube.

In another aspect, the at least partially transparent container has a cylindrical shape In another aspect, the at least partially transparent container is a glass tube.

In another aspect, the at least partially transparent container has a length up to 388 millimeters.

In another aspect, the at least partially transparent container has a diameter up to 32.5 millimeters.

In another aspect, the at least partially transparent container is at least partially fabricated from quartz glass.

In another aspect, the lamp assembly further comprises two electrical leads connecting to the pair of sealed conductive ends of the at least partially transparent container.

In another aspect, the ceramic arc tube uses about 200 volts when illuminating.

In another aspect, the ceramic arc tube produces about 3 amps when illuminating.

In another aspect, the ceramic arc tube is at least partially fabricated from polycrystalline alumina.

In another aspect, the maximum attainable temperature of the ceramic arc tubes is about 700° Fahrenheit.

In another aspect, the ionizable gaseous mixture consists of a mercury vapor and at least one metal-halide.

In another aspect, the ballast comprises an electronic ballast or an electromagnetic ballast.

One objective of the present invention is to provide an enhanced lighting ceramic metal-halide lamp assembly having a 630 watt double ended ceramic metal-halide lamp.

Another objective is to connect a plurality of ceramic arc tubes with two U-shaped coupling mechanisms that provide both conductivity, and a buffering clearance between the ceramic arc tubes.

Yet another objective is to efficiently generate an electrical arc in the ceramic arc tubes with electrodes in a ballast.

Yet another objective is to produce 630 watts of power.

Yet another objective is to provide ceramic arc tubes having a maximum attainable temperature of about 700° Fahrenheit.

Yet another objective is to protect the ceramic arc tube from buffering.

Yet another objective is to securely fasten the ceramic arc tube concentrically in the container.

Yet another objective is to increase the life of the lamp assembly.

Yet another objective is to create improved color temperatures, color renderings, and luminous efficacies for the lamp assembly.

Yet another objective is to provide a ceramic arc tube that reduces reactions with the ionizable gaseous mixture contained within.

Yet another objective is to provide a resilient fastening bracket to help stabilize the ceramic arc tubes inside the elongated container.

Yet another objective is to provide an inexpensive to manufacture enhanced lighting ceramic metal-halide lamp assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 3A illustrates a performance data table that lists experimental data of the lamp assembly, in accordance with an embodiment of the present invention;

FIG. 3B illustrates an electrical characteristics table that references the nominal lamp wattage as 630 W, in accordance with an embodiment of the present invention;

FIG. 3C illustrates a physical descriptions table that references physical characteristics of the container and ceramic arc tubes, in accordance with an embodiment of the present invention.

Like reference numerals refer to like parts throughout the various views of the drawings.

DETAILED DESCRIPTION OF THE INVENTION

Figure 1:
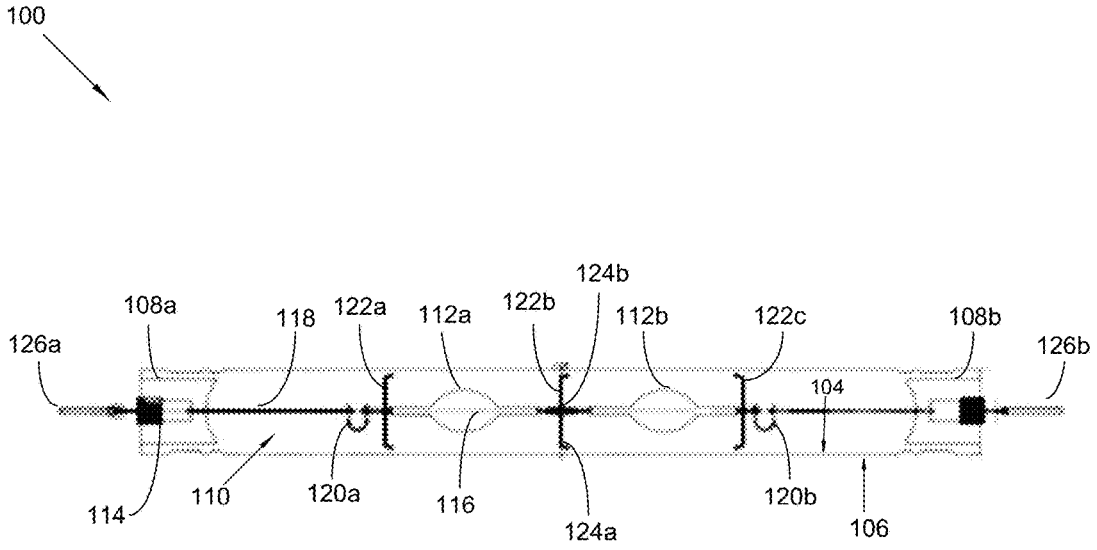
FIG. 1 illustrates a perspective view of an exemplary an enhanced lighting ceramic metal-halide lamp assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An enhanced lighting ceramic metal-halide lamp assembly 100 is referenced in FIGS. 1-4. The enhanced lighting ceramic metal-halide lamp assembly 100, hereafter "lamp assembly 100", provides a metal-halide lamp that operates in such a manner and is structurally configured to illuminate at high temperatures, have an increased life span, and illuminate with improved color temperatures, color renderings, and luminous efficacies.

The lamp assembly 100 provides an at least partially transparent container 102 forming a vacuum. Inside the container 102, a plurality of ceramic arc tubes 112*a*, 112*b* are connected by two U-shaped coupling mechanisms 120*a*, 120*b*. The coupling mechanisms 120*a*, 120*b* are conductive and resilient, so as to provide both conductivity, and a buffering clearance between the ceramic arc tubes 112*a-b* and the ends of the transparent container 102. The lamp assembly 100 is also unique in that it provides a 630 watt double ended ceramic metal-halide lamp. The ceramic arc tube produces 630 watts, uses about 200 volts and 3 Amps when illuminating. Further, the lamp assembly utilizes at least one fastening bracket 122*a*, 122*b*, having a resiliency that helps to stabilize the ceramic arc tubes 112*a-b* inside the transparent container 102.

These novel features result in an increased life span for the ceramic arc tubes 112*a*, 112*b*. This further results in enhanced lighting by the lamp assembly 100, while operating at higher temperatures up to 700° Fahrenheit. This also enables energy saving generation of improved color temperatures, color renderings, and luminous efficacies. The lamp assembly 100 is also efficacious for significantly reducing reactions with the ionizable gaseous mixture contained within. Further, the lamp assembly 100 operates at higher temperature which is adapted to boost performance and quality-of-light characteristics, such as lumen maintenance, lamp color-shift and spread stability, color rendering index, and dimming.

As referenced in FIG. 1, the lamp assembly 100 comprises an at least partially transparent container 102. The container 102 is defined by an inner surface 104, an outer surface 106, a pair of sealed conductive ends 108*a*, 108*b*, and an inner volume 110. The sealed conductive ends 108*a*, 108*b* are sufficiently conductive, so as to conduct an electrical current through the inner volume. The inner volume 110 is sealed and forms a vacuum. In some embodiments, the container 102 may have a generally cylindrical shape. Though other shapes are possible.

In one non-limiting embodiment, the container 102 is a glass tube having a length of up to 388 millimeters, and a diameter of up to 32.5 millimeters. In one non-limiting embodiment, the at least partially transparent container 102 is at least partially fabricated from quartz glass. The quartz glass material is efficacious for enabling optimal passage of light through. Though other materials that are at least partially transparent may be used.

Figure 4:
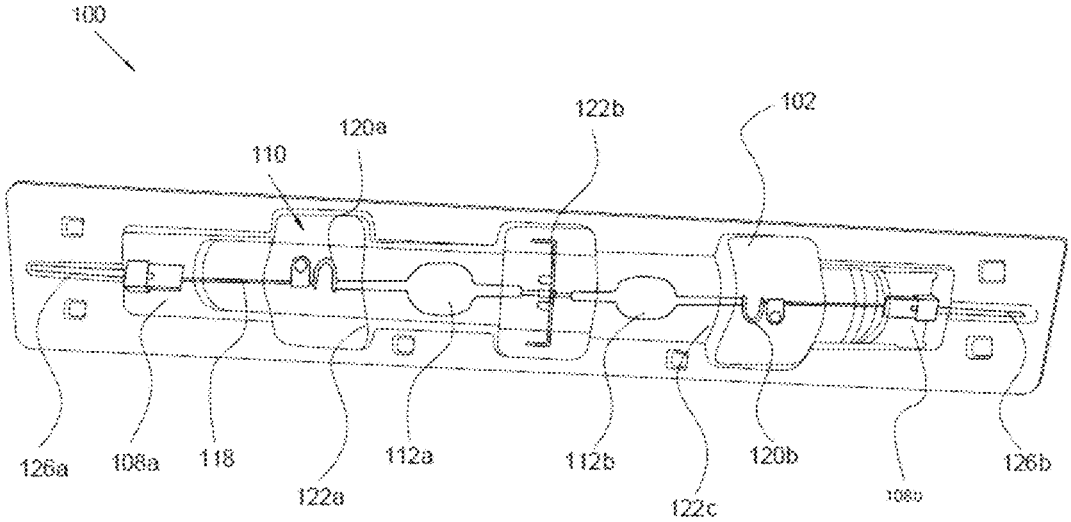
FIG. 4 illustrates a top view of an exemplary ceramic arc tubes connected by two U-shaped coupling mechanisms, in accordance with an embodiment of the present invention.

The lamp assembly 100 further comprises a plurality of ceramic arc tubes 112*a*, 112*b* (FIG. 4). The ceramic arc tubes 112*a-b* are disposed in the inner volume 110 of the container 102. This being a halide-metal style lamp, the ceramic arc tubes 112*a-b* are filled with an ionizable gaseous mixture. The ionizable gaseous mixture may include a mercury vapor and at least one metal-halide. In one non-limiting embodiment, the ceramic arc tube is at least partially fabricated from polycrystalline alumina. Though in other embodiments, different ceramic-based materials may be used to fabricate the ceramic arc tubes 112*a-b*.

In one embodiment, the lamp assembly 100 provides a ballast 114 that is disposed in the inner volume 110 of the ceramic arc tubes 112*a*, 112*b*. In some embodiments, the ballast 114 may include an electronic ballast or an electromagnetic ballast. In another embodiment, the ballast 114 comprises at least one electrode 116 generating an electric arc through the ionizable gaseous mixture. The electric arc is operational to vaporize the gaseous mixture, which creates a plasma to generate illumination in the ceramic arc tubes 112*a-b*.

In one non-limiting embodiment, a wire 118 may extend between the pair of sealed conductive ends 108*a*, 108*b* of the at least partially transparent container 102. The wire 118 carries an electrical current through the ballast 114, so as to enable energizing the electrode 116. In one non-limiting embodiment, the lamp assembly 100 further comprises two electrical leads 126*a*, 126*b* that connect to the sealed conductive ends 108*a*, 108*b* of the container 102. The electrical leads 126*a*, 126*b* carry current to the ends of the wire 118.

In one embodiment, the ceramic arc tubes 112*a*, 112*b* produce about 630 watts of power when illuminating. In another embodiment, the ceramic arc tube uses about 200 volts when illuminating, and produces about 3 amps when illuminating (FIG. 3C). In another embodiment, the illumination comprises a color rendition between 80 to 96 CRI. Additionally, the polycrystalline alumina composition of the ceramic arc tubes 112*a-b* is effective for increasing the operating temperature, such that the maximum attainable temperature of the ceramic arc tubes 112*a-b* is about 700° Fahrenheit.

Figure 2A:
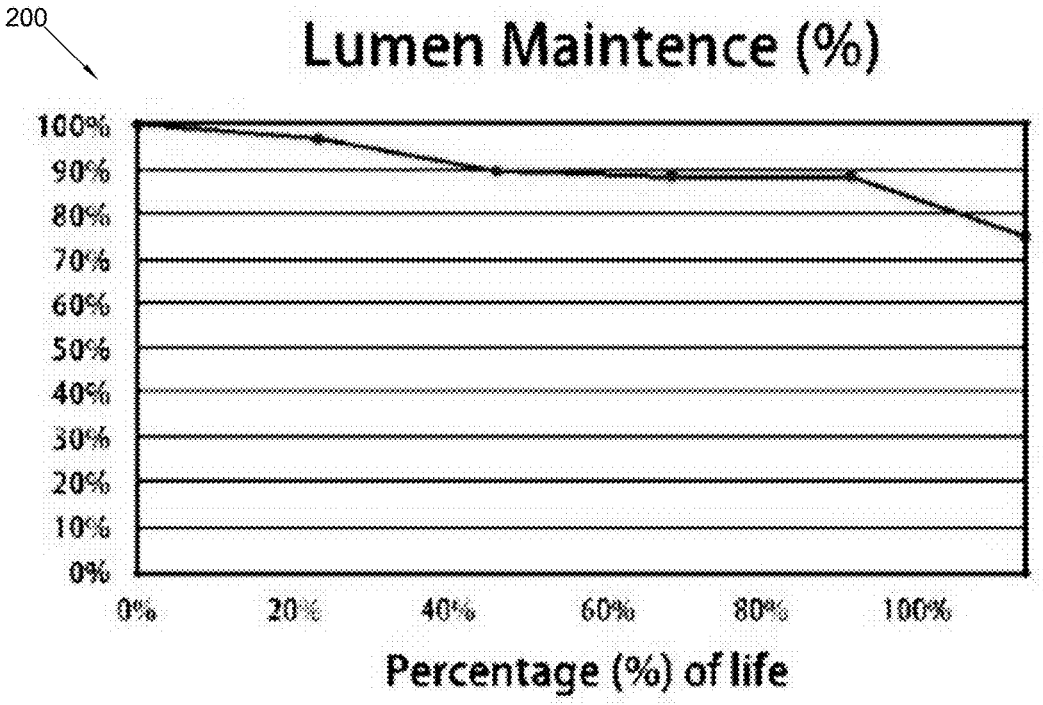
FIG. 2A illustrates a life span graph, showing experimental use of the lamp assembly, in accordance with an embodiment of the present invention.
Figure 2B:
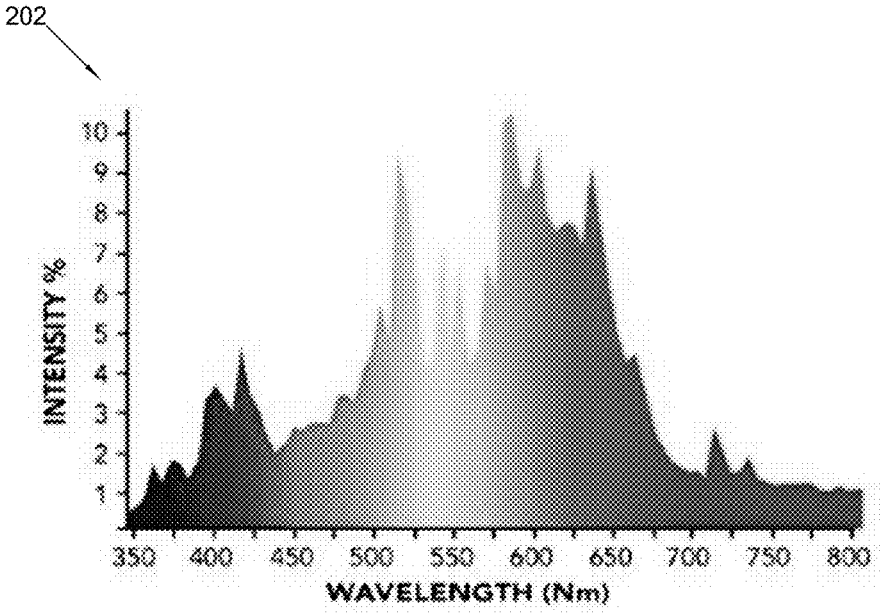
FIG. 2B illustrates a wavelength graph showing the enhanced lighting that the lamp assembly is able to generate over a wide wavelength spectrum, in accordance with an embodiment of the present invention.
Figure 2C:
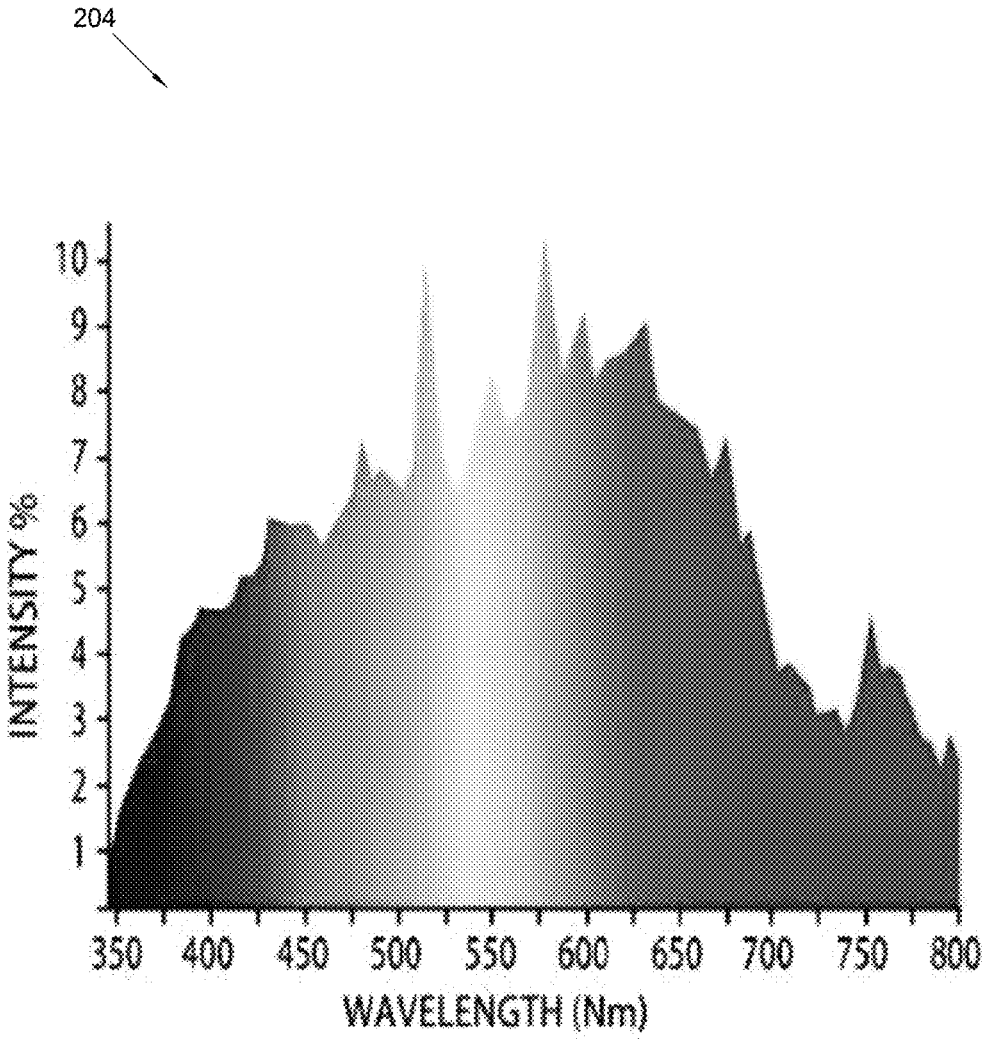
FIG. 2C illustrates a second wavelength graph showing the enhanced lighting that the lamp assembly is able to generate over a wide wavelength spectrum, in accordance with an embodiment of the present invention.

FIGS. 2A-2C reference graphs that reflect experimental use of the lamp assembly 100; and specifically those of the ceramic arc tubes 112*a-b* and the container 102. As shown in FIG. 2A, the use of a 630 watt double ended ceramic metal-halide lamp enhances the life span of the lamp assembly 100. The buffering effect from the U-shaped coupling mechanisms 120*a*, 120*b* also prevents the lamp assembly 100 from having a shortened life span. In support of the increased life span, FIG. 2A shows a lumen maintenance graph 200 with a graph line decreasing at a flat slope, from 100% to about 78%. Such a flat slope is an indication that the life span of the ceramic arc tubes 112*a-b* is greater than the traditional metal-halide lamp known in the art. For example, performance data table 300 in FIG. 3A references experimental data that shows the rated average life of the lamp assembly 100 is about 10,000 hours.

Turning now to FIG. 2B, a wavelength graph 202 shows the enhanced lighting that the lamp assembly 100 is able to generate over a wide wavelength spectrum. As shown, the intensity of the light peaks at about 600 nanometer wavelength. Though shorter wavelengths around 500 nanometers also produce high intensities of light. These optimal wavelength patterns correspond to the 630 watt configuration of the ceramic arc tubes 12*a-b*.

FIG. 2C references a second wavelength graph 204 that shows a second experimental run that achieves enhanced lighting that the lamp assembly 100 is able to generate over a wide wavelength spectrum. This graph 204 shows greater intensities between 500 nm to 600 nm wavelength. The second graph is based on a different initial lumens at rated watts (65,000 Lm), correlated color temperature (4200K), Par value (1150 12,000 μmol/s), and lumens per watt (105 lm/w) than the wavelength graph 202 shown in FIG. 2B.

FIGS. 3A-3C reference the specifications of the lamp assembly 100; and specifically those of the ceramic arc tubes 112*a-b* and container 102. A performance data table 300 lists experimental data of the lamp assembly 100 (FIG. 3A). The table 300 shows that the initial lumens at rated watts after 100 hours of operation are about 78,500 LM. The rated average life is about 10,000 hours. The warm up time is 7 minutes. Further, the correlated color temperature is 3100K. The color rendering index is > or equal to 90. The operating position is HOR±15°. The PAR value (380-780 nm) is 12,000 μmol/s. Further, the lumens per watt are 125 lm/w. It is significant to note that the specifications in table 300 are non-limiting.

Turning now to FIG. 3B, an electrical characteristics table 302 references the nominal lamp wattage as 630 W. This wattage is consistent with the use of a 630 watt double ended ceramic metal-halide lamp. The nominal lamp voltage is about 200V. The nominal lamp current is about 3 Amps. It is significant to note that the specifications in table 302 are non-limiting.

Continuing with the specifications, FIG. 3C illustrates a physical descriptions table 304 that references physical characteristics of the container 102 and ceramic arc tubes 112*a-b*. The container 102 has a length of up to 388 millimeters, and a diameter of up to 32.5 millimeters. The pulse position (electrical degrees) is 60°-90° and 240°-270°. Further, the maximum attainable temperature of the ceramic arc tubes 112*a-b* is about 700° Fahrenheit. The bulb (container 102) designation is T32.5. Further, the ceramic arc tube is at least partially fabricated from polycrystalline alumina. The bulb (container 102) is fabricated from quartz glass and has a clear bulb finish. It is significant to note that the specifications in table 304 are non-limiting.

Looking now at FIG. 4, the lamp assembly 100 further provides two U-shaped coupling mechanisms 120*a*, 120*b*. The two U-shaped coupling mechanisms 120*a-b* are integral to the wire 118. The two U-shaped coupling mechanisms 120*a-b* connect each of the ceramic arc tubes 112*a-b* to one of the sealed conductive ends 108*a*, 108*b* of the container 102, serving as a *nexus* therebetween. This connecting function reduces the tension on the wire 118; thus creating a stronger interconnection with components along the wire 118 and between the ceramic arc tubes 112*a-b*.

In one embodiment, the two U-shaped coupling mechanisms 120*a-b* are defined by a conductive material, and are generally resilient. This may include a tensioned metal leaf or other material that creates a buffering oscillation against the surface of the ceramic arc tubes 112*a-b*. In this manner, the two U-shaped coupling mechanisms 120*a-b* provide both the benefits of conductivity and a buffering clearance between the ceramic arc tubes 112*a-b* and the sealed conductive ends 108*a*, 108*b* of the container 102.

Looking back at FIG. 1, the lamp assembly 100 further provides at least one fastening bracket 122*a*, 122*b* that helps secure the ceramic arc tubes 112*a-b* in a stabilized position inside the container 102. The fastening bracket 122*a-b* is defined by a first end 124*a* and a second end 124*b*. The first end 124*a* engages the inner surface 104 of the container 102. The second end 124*b* engages the ceramic arc tubes 112*a-b*. In one embodiment, the fastening bracket 122*a-b* has an elongated shape with arced ends, such that the first end 124*a* is arced inwardly. The second end 124*b* may follow a radial path, in conformance with the ceramic arc tubes 112*a-b*.

In some embodiments, the fastening bracket 122*a-b* is resilient, so as to enable buffering and to protect against impactful forces against the container 102 or ceramic arc tubes 112*a-b*. Similar to the two U-shaped coupling mechanisms 120*a-b*, the fastening bracket 122*a-b* are generally resilient, and may include a tensioned metal leaf or other material that creates a buffering oscillation against the surface of the ceramic arc tubes 112*a-b* and container 102.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An enhanced lighting ceramic metal-halide lamp assembly, the assembly comprising:

an at least partially transparent container defined by an inner surface, an outer surface, a pair of sealed conductive ends, and an inner volume defined by a vacuum;

a plurality of ceramic arc tubes disposed in the inner volume of the at least partially transparent container, the ceramic arc tubes being filled with an ionizable gaseous mixture;

a ballast disposed in the inner volume of the ceramic arc tubes, the ballast comprising at least one electrode generating an electric arc through the ionizable gaseous mixture;

whereby the electric arc vaporizes the gaseous mixture to generate illumination;

whereby the ceramic arc tube produces about 630 watts of power when illuminating;

a wire extending between the pair of sealed conductive ends of the at least partially transparent container, the wire carrying an electrical current through the ballast;

two U-shaped coupling mechanisms integral to the wire, the two U-shaped coupling mechanisms connecting each of the ceramic arc tubes to one of the sealed conductive ends of the container, the two U-shaped coupling mechanisms defined by a conductive material, the two U-shaped coupling mechanisms being generally resilient;

whereby the two U-shaped coupling mechanisms provide conductivity and a buffering clearance between the ceramic arc tubes and the sealed conductive ends of the container; and at least one fastening bracket defined by a first end and a second end, the first end engaging the inner surface of the at least partially transparent container for stabilizing the ceramic arc tubes, the second end engaging the ceramic arc tubes.

2. The assembly of claim 1, wherein the lamp assembly comprises a 630 watt double ended ceramic metal-halide lamp.

3. The assembly of claim 1, wherein the at least partially transparent container has an elongated cylindrical shape.

4. The assembly of claim 1, wherein the at least partially transparent container is a glass tube.

5. The assembly of claim 1, wherein the at least partially transparent container has a length up to 388 millimeters.

6. The assembly of claim 1, wherein the at least partially transparent container has a diameter up to 32.5 millimeters.

7. The assembly of claim 1, wherein the at least partially transparent container is at least partially fabricated from quartz glass.

8. The assembly of claim 1, further comprising two electrical leads connecting to the pair of sealed conductive ends of the at least partially transparent container.

9. The assembly of claim 1, wherein the ceramic arc tubes use about 200 volts when illuminating.

10. The assembly of claim 1, wherein the ceramic arc tubes produce about 3 amps when illuminating.

11. The assembly of claim 1, wherein the ceramic arc tubes are at least partially fabricated from polycrystalline alumina.

12. The assembly of claim 1, wherein the maximum attainable temperature of the ceramic arc tubes is about 700 degrees Fahrenheit.

13. The assembly of claim 1, wherein the ionizable gaseous mixture consists of a mercury vapor and at least one metal-halide.

14. The assembly of claim 1, wherein the ballast comprises an electronic ballast or an electromagnetic ballast.

15. An enhanced lighting ceramic metal-halide lamp assembly, the assembly comprising:

an at least partially transparent container defined by an inner surface, an outer surface, a pair of sealed conductive ends, and an inner volume defined by a vacuum;

a plurality of ceramic arc tubes disposed in the inner volume of the at least partially transparent container, the ceramic arc tubes being filled with an ionizable gaseous mixture consisting of a mercury vapor and at least one metal-halide, the ceramic arc tubes being at least partially fabricated from polycrystalline alumina;

a ballast disposed in the inner volume of the ceramic arc tubes, the ballast comprising at least one electrode generating an electric arc through the ionizable gaseous mixture;

whereby the electric arc vaporizes the gaseous mixture to generate illumination;

whereby the ceramic arc tubes produce about 630 watts of power when illuminating;

a wire extending between the pair of sealed conductive ends of the at least partially transparent container, the wire carrying an electrical current through the ballast;

two U-shaped coupling mechanisms integral to the wire, the two U-shaped coupling mechanisms connecting each of the ceramic arc tubes to one of the sealed conductive ends of the container, the two U-shaped coupling mechanisms defined by a conductive material, the two U-shaped coupling mechanisms being generally resilient;

whereby the two U-shaped coupling mechanisms provide conductivity and a buffering clearance between the ceramic arc tubes and the sealed conductive ends of the container; and at least one fastening bracket defined by a first end and a second end, the first end engaging the inner surface of the at least partially transparent container for stabilizing the ceramic arc tubes, the second end engaging the ceramic arc tubes.

16. The assembly of claim 15, further comprising two electrical leads connecting to the pair of sealed conductive ends of the at least partially transparent container.

17. The assembly of claim 15, wherein the ceramic arc tubes use about 200 volts when illuminating.

18. The assembly of claim 15, wherein the ceramic arc tubes produce about 3 amps when illuminating.

19. The assembly of claim 15, wherein the lamp assembly comprises a 630 watt double ended ceramic metal-halide lamp.

20. An enhanced lighting ceramic metal-halide lamp assembly, the assembly consisting of:

an at least partially transparent container defined by an inner surface, an outer surface, a pair of sealed conductive ends, and an inner volume defined by a vacuum, the at least partially transparent container having a length of up to 388 millimeters, and a diameter of up to 32.5 milliliters;

a plurality of ceramic arc tubes disposed in the inner volume of the at least partially transparent container, the ceramic arc tubes being filled with an ionizable gaseous mixture consisting of a mercury vapor and at least one metal-halide, the ceramic arc tubes being at least partially fabricated from polycrystalline alumina;

whereby the ceramic arc tubes use about 200 volts when illuminating;

whereby the ceramic arc tubes produce about 3 amps when illuminating;

a ballast disposed in the inner volume of the ceramic arc tube, the ballast comprising at least one electrode generating an electric arc through the ionizable gaseous mixture;

whereby the electric arc vaporizes the gaseous mixture to generate illumination;

whereby the ceramic arc tubes produce about 630 watts of power when illuminating;

two electrical leads connecting to the pair of sealed conductive ends of the at least partially transparent container;

a wire extending between the pair of sealed conductive ends of the at least partially transparent container, the wire carrying an electrical current through the ballast;

two U-shaped coupling mechanisms integral to the wire, the two U-shaped coupling mechanisms connecting each of the ceramic arc tubes to one of the sealed conductive ends of the container, the two U-shaped coupling mechanisms defined by a conductive material, the two U-shaped coupling mechanisms being generally resilient;

whereby the two U-shaped coupling mechanisms provide conductivity and a buffering clearance between the ceramic arc tubes and the sealed conductive ends of the container; and at least one fastening bracket defined by a first end and a second end, the first end engaging the inner surface of the at least partially transparent container for stabilizing the ceramic arc tubes, the second end engaging the ceramic arc tubes.

* * * * *